US007805803B2

(12) United States Patent
Andrup et al.

(10) Patent No.: US 7,805,803 B2
(45) Date of Patent: Oct. 5, 2010

(54) SUCTION NOZZLE FOR A VACUUM CLEANER, COMPRISING A DUST FLOW DISPLAY DEVICE

(75) Inventors: Klemens Andrup, Verl (DE); Diethard Becker, Bielefeld (DE); Seyfettin Kara, Spenge (DE); Oliver Liebig, Bielefeld (DE); Rainer Schultz, Guetersloh (DE); Heiko Stork, Herford (DE); Stefan Tiekoetter, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1001 days.

(21) Appl. No.: 10/598,007

(22) PCT Filed: Feb. 1, 2005

(86) PCT No.: PCT/EP2005/000944

§ 371 (c)(1),
(2), (4) Date: Aug. 15, 2006

(87) PCT Pub. No.: WO2005/077243

PCT Pub. Date: Aug. 25, 2005

(65) Prior Publication Data

US 2007/0180648 A1 Aug. 9, 2007

(30) Foreign Application Priority Data

Feb. 16, 2004 (DE) ..... 10 2004 007 677

(51) Int. Cl.
*A47L 7/00* (2006.01)

(52) U.S. Cl. ..... 15/339; 15/415.1

(58) Field of Classification Search ..... 250/573; 15/319, 339, 415.1; 356/338, 439
See application file for complete search history.

(56) References Cited

U.S. PATENT DOCUMENTS

| | | | |
|---|---|---|---|
| 1,565,382 | A | 12/1925 | McClatchie |
| 3,989,311 | A | 11/1976 | Debrey |
| 4,114,557 | A | 9/1978 | De Brey |
| 4,175,892 | A | 11/1979 | De Brey |

(Continued)

FOREIGN PATENT DOCUMENTS

| | | |
|---|---|---|
| DE | 93 11 014 | 9/1993 |

(Continued)

*Primary Examiner*—David A Redding
(74) *Attorney, Agent, or Firm*—Leydig, Voit & Mayer, Ltd.

(57) ABSTRACT

A suction nozzle for a vacuum cleaner that can be connected to a suction pipe and/or a suction tube of the vacuum cleaner includes a nozzle part that can be connected to the suction pipe or the suction tube by means of a tubular connection part. A dust sensor is arranged in the flow path of the vacuum cleaner, the signals thereof being evaluated by a battery-operated electronic control device that can be activated by a low-pressure switch. During operation, said control device controls a display device displaying the dust flow. The control device, the low-pressure switch, the display elements displaying the dust flow, and a battery compartment for receiving the batteries are arranged in a housing formed on the upper side of the tubular connection part. The dust sensor is arranged beneath the housing, inside the upper region of the connection part, in the dust air stream.

12 Claims, 3 Drawing Sheets

U.S. PATENT DOCUMENTS

| | | | |
|---|---|---|---|
| 4,767,213 | A | 8/1988 | Hummel |
| 2003/0146739 | A1 | 8/2003 | Bertram et al. |

FOREIGN PATENT DOCUMENTS

| | | |
|---|---|---|
| DE | 69607629 | 10/2000 |
| DE | 202 07 071 | 9/2002 |
| EP | 0231419 | 8/1987 |
| EP | 0759157 | 2/1997 |
| EP | 0845237 | 6/1998 |
| JP | 02131735 | 5/1990 |
| JP | 03145333 | 6/1991 |

SUCTION NOZZLE FOR A VACUUM CLEANER, COMPRISING A DUST FLOW DISPLAY DEVICE

CROSS-REFERENCE TO PRIOR APPLICATION

This application is a U.S. National Phase of International Patent Application No. PCT/EP2005/000944, filed Feb. 1, 2005, which claims priority to German Patent Application No. DE 10 2005 007 677.4, filed Feb. 16, 2004, the entire disclosure of which is incorporated by reference herein. The International Application was published in German on Aug. 25, 2005 as WO 2005/077243.

FIELD OF THE INVENTION

The present invention relates to a suction nozzle for a vacuum cleaner, said suction nozzle being connectable to a suction wand and/or to a suction hose of the vacuum cleaner, the suction nozzle having a nozzle part which is provided with a suction mouth and is connectable to the suction wand or to the suction hose of the vacuum cleaner via a tubular connection part, the suction nozzle including a dust-flow sensor which is disposed in the flow path of the vacuum cleaner and whose signals are analyzed by an electronic control device, and, during operation, the control device controlling an indicating device which indicates the dust flow.

BACKGROUND

For quite some time, there has been a desire to provide vacuum cleaners with a measuring and indicating device that allows the user to assess how the level of cleanliness of the surface to be treated varies during the vacuum cleaning process. In fact, it would be of great help to the operator if he or she could see from an indicating device that, after a certain vacuum cleaning time, there remains hardly any dust-laden air being conveyed through the flow-conveying system of the vacuum cleaner, so that the vacuum cleaning process is not unnecessarily prolonged. To remedy this, a number of proposals have been made in the patent literature, but these proposals have not yet led to any implementation that would be relevant in practice.

For example, it is known from European publication EP 0 231 419 A1 to provide an indicating and control device in the form of an attachment or accessory for a vacuum cleaner, said indicating and control device being installable in the flow-conveying system of the vacuum cleaner. This indicating and control device should be activatable by a low-pressure switch and operate with optical dust-detecting means. It was also proposed to mount this unit on the vacuum cleaner or its parts (suction brush, suction wand, handle, suction hose) at a position adjacent to the suction region of the vacuum cleaner. That prior publication does not include any specific information on how and where to install the sensor which is at the heart of such a system. There is no known practical implementation based on this design approach.

A practical embodiment in which the dust-flow sensing and indicating device is mounted in a suction nozzle is described in DE 93 11 014 U1 and DE 202 07 071 U1, respectively. Both design approaches have in common that the sensing and indicating device is located in the bottom part of the suction nozzle.

In DE 93 11 014 U1, a removable sub-housing is provided above the bottom part of the suction nozzle to accommodate the sensor and the indicating elements. The sensor is formed by optical dust-detecting means provided in the inlet duct or in the inlet region of the bottom part of the suction nozzle. The floor nozzle depicted in that prior publication illustrates the drawbacks of this embodiment particularly well. Since the additional elements (sensor, battery-operated control device, and indicating devices) are accommodated directly in the bottom part of the suction nozzle, the size of the bottom part is inevitably increased. Therefore, it is no longer possible to move such a suction nozzle into the narrow free spaces under furniture. Moreover, in cases where the bottom part of the suction nozzle does disappear under a piece of furniture, the indicating device is no longer visible. Furthermore, the bottom part of the suction nozzle, in particular, is inevitably exposed to strong shocks. This may easily lead to failures of the control electronics located in the bottom part and of the sometimes fragile sensor elements.

These are certainly the crucial reasons why, up to the present time, no suction nozzle having an indicating and sensing device mounted directly in the bottom part of the suction nozzle could be established in the market to an appreciable extent.

All design approaches described above are based on providing a sensor in the form of an optical dust-detecting means which, for system-inherent reasons alone, has certain drawbacks. It is not very easy to provide an optical measurement section in the confined mounting space in the flow channels of the air-conveying system of a vacuum cleaner. Moreover, an optical measuring system is not sufficiently reliable and accurate for certain purposes. A particular disadvantage of optical systems is that, in addition to the actual dust, they also respond to carpet fibers resulting from wear and tear of a carpet, but do not allow any conclusions about the level of cleanliness.

In contrast, a design approach described in EP 0 759 157 B1 is particularly advantageous in that it uses a piezoelectric sensor device which allows even minute dust particles to be reliably detected without the signal being affected so much, for example, by carpet fibers. The embodiment described in that patent proposes for the piezoelectric sensor to be mounted in the inlet tube or in an inlet connector of the vacuum cleaner. When the dust particles present in the air-flow path hit the piezoelectric sensor they transfer part of their energy to the sensor, the piezoelectric sensor converting the kinetic energy into a corresponding electrical signal (piezoelectric voltage). That prior publication does indeed describe the physical sensor system and the electronic control system in detail, but it does not provide any details on where and how to install the individual elements-sensor, control electronics, indicating device and, possibly, a battery provided for power supply.

SUMMARY OF THE INVENTION

It is an object of the present invention that a sensing and indicating device be accommodated in the air-flow path of the vacuum cleaner in such a manner that the components involved in the overall system are installed in a space-saving and ergonomically favorable manner. A further or alternate object is to find an installation location for the sensor, which has favorable flow characteristics and ensures trouble-free and reliable operation.

The present invention provides a suction nozzle for a vacuum cleaner, said suction nozzle being connectable to a suction wand and/or to a suction hose of the vacuum cleaner, the suction nozzle having a nozzle part which is provided with a suction mouth and is connectable to the suction wand or to the suction hose of the vacuum cleaner via a tubular connection part, the suction nozzle including a dust sensor which is disposed in the flow path of the vacuum cleaner and which is located in the dust-air stream inside the upward portion of the connection part and whose signals are analyzed by an electronic control device, during operation, the control device controlling an indicating device which indicates the dust flow, the indicating elements indicating the dust flow being disposed in a housing or receiving chamber formed on the upper side of the tubular connection part, wherein the dust sensor is insertable underneath the housing through an opening formed on the upper side of the connection part and protrudes into the dust-air stream near the upper wall area of the connection part. Advantageous embodiments and refinements of the present invention will become apparent from the claims. The present invention also provides an accessory or retrofit solution in the form of a separate connection part, which can be connected, as an independent part, directly to a floor nozzle of the vacuum cleaner.

The present invention provides significant advantages. It was found that especially the upwardly directed connection part of the suction nozzles is particularly suitable for accommodating the sensor, control and indicating system.

Nevertheless, the bottom part or the suction mouth part of the suction nozzle can still be of flat construction. In addition, by forming an attachable housing on the upper side of the connection part or the upward connector member, all components can be accommodated in a manner which is ergonomically favorable and compatible with styling requirements. The battery compartment, for example, is easily accessible, and the batteries are very easy to replace. Moreover, the indicating elements, which indicate the condition of the suction air stream in the generally known manner by means of indicating LED's, can be installed such that they are easily visible to the user. This display window is always in the direct line of sight of the user, because during vacuum cleaning, he or she is always looking along the suction wand toward the suction nozzle area.

Another, particularly essential features is that the piezoelectric sensor is mounted on the lower side of the upper wall of the connection part. This decisively contributes to the special method of operation of the system. When heavy parts and particles are still present in the suction air stream, these are conveyed by the dust-air stream generally beneath the sensor and into the collecting chamber system of the vacuum cleaner. Thus, the sensor is not constantly exposed to impinging heavy particles, which helps prevent damage to the sensor. In addition, it can show its advantages when it is important. This is generally the case when the level of dust and the number of particles in the air stream become less and less as the vacuum cleaning process proceeds. Even then, the sensor can still detect minute dust particles in the air stream, which allows it to provide meaningful information to the user until a very high level of cleanliness is reached. This is very important especially for allergic persons. It is very advantageous for these people that the dust indicator according to the present invention allows detection of ultrafine dust, which is known to be allergenically very active.

Another advantage of the new system is that it includes a holding device to which all essential components are attached, such as the dust sensor, the printed circuit board containing the control device, the low-pressure switch, and the indicating elements. This makes it possible to achieve a space-saving and compact design. Furthermore, easy installation and removal during servicing are ensured because the holding device can be detachably mounted in the opening of the connection part of the suction nozzle.

Moreover, in the installed state, the system is configured such that the air inlet conduit of the pressure switch is located in the wind shadow of the holding device, thus preventing accumulation of dirt on the air inlet conduit, which would otherwise impair the proper functioning of the pressure switch.

BRIEF DESCRIPTION OF THE DRAWINGS

An exemplary embodiment of the present invention is shown in the drawings in a purely schematic way and will be described in more detail below. In the drawing.

DETAILED DESCRIPTION

Figure 1:
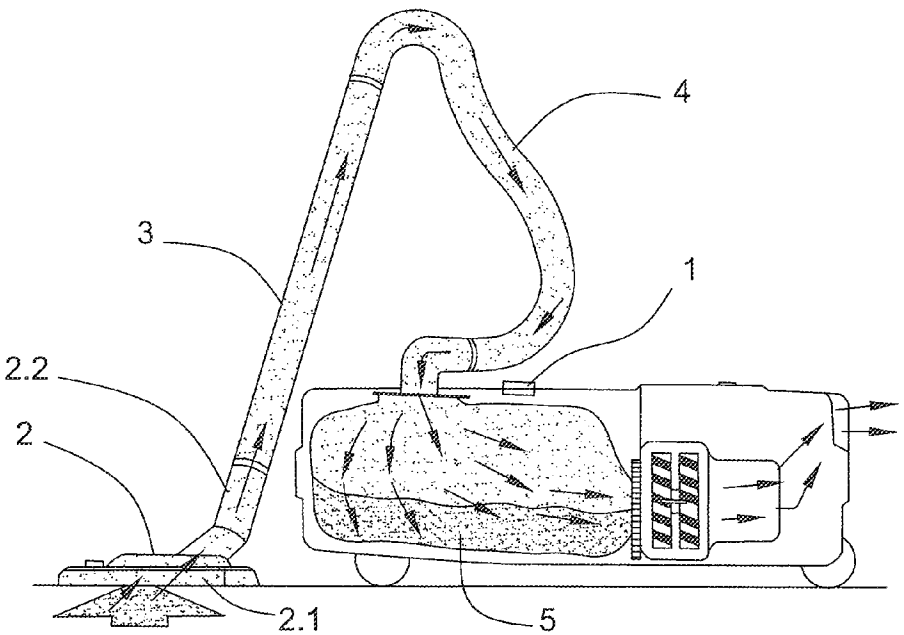
FIG. 1 is a simplified schematic representation of a vacuum cleaner, including a suction nozzle, a suction wand, and a suction hose.

The schematic view of FIG. 1 shows vacuum cleaner (1) having a suction nozzle (2), a rigid suction wand (3), and a flexible suction hose (4) through which the dust-laden air is conveyed in the direction of the arrows into dust-collecting chamber (5). Usually, suction nozzle (2) is detachably connected to suction wand (3). In the example shown, suction nozzle (2) is a floor nozzle and is substantially formed by suction mouth part or nozzle part (2.1) and connection part (2.2). Nozzle part (2.1) and connection part (2.2) are typically connected to each other by a so-called "tilt and turn joint" mounted in coupling part (2.3).

Figure 2:
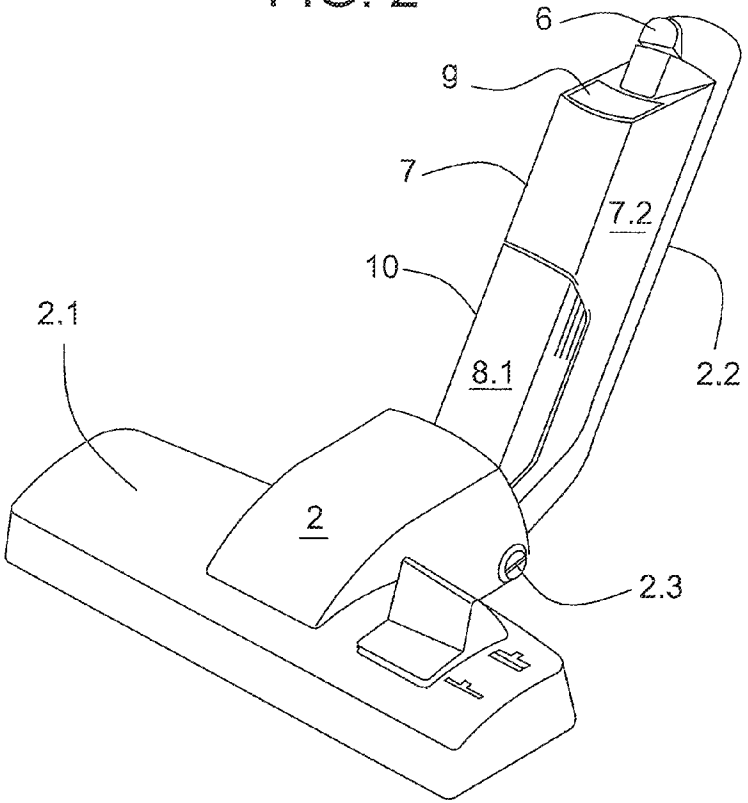
FIG. 2 is a perspective detail view of the suction nozzle according to the present invention.

A suction nozzle designed in accordance with the present invention is shown in detail in FIG. 2. Here too, the nozzle part (2.1) of suction nozzle (2) is connected by the tilt and turn joint mounted in coupling part (2.3) to connection part (2.2), which serves as a connector member. Connection part (2.2) is provided at its upper end with a locking handle (6) by which suction nozzle (2) can be attached to suction wand (3) of the vacuum cleaner.

On the upper side of the upward connection part (2.2), on the side facing forward toward nozzle part (2.1) of suction nozzle (2), connection part (2.2), is formed to include a cover (7).

Figure 4:
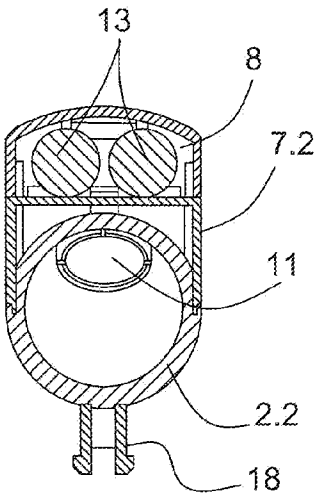
FIG. 4 is a cross-sectional view taken along line II-II, showing the tubular portion of the connector member, looking toward the dust sensor.
Figure 3:
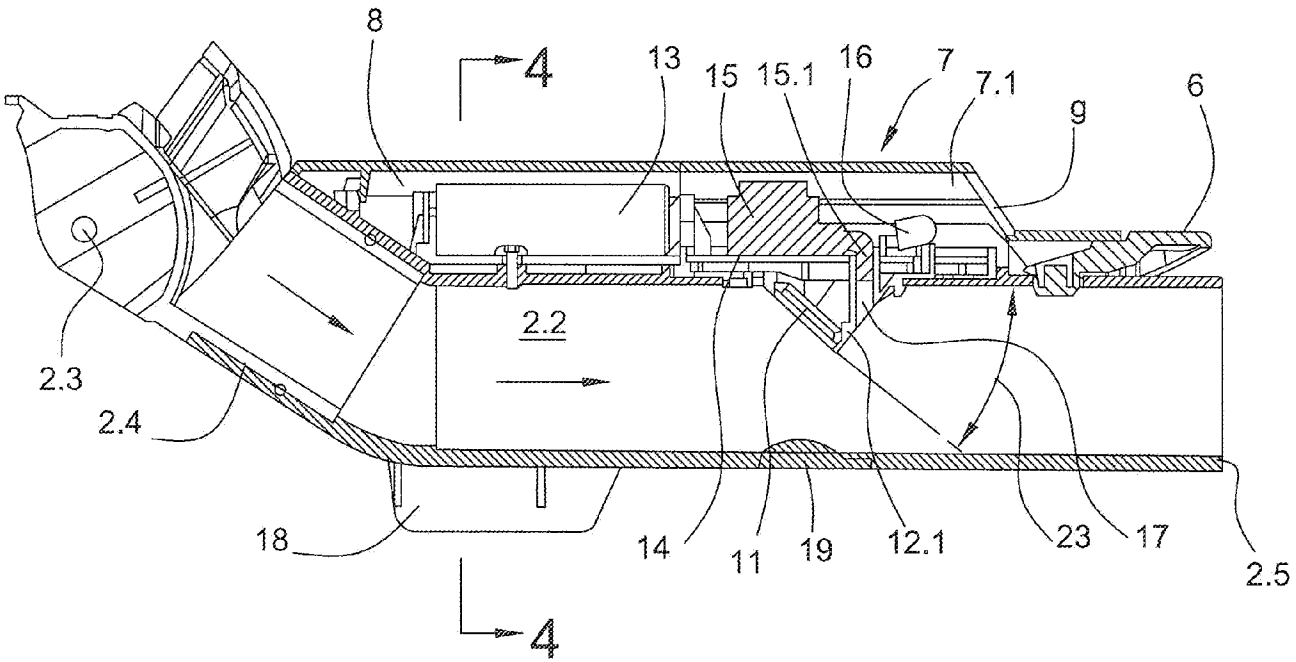
FIG. 3 shows the suction nozzle of the present invention in a side view and, in a cross-sectional view, part of the region where the sensor, indicating and control device is accommodated in the connector member.

FIGS. 3 and 4 are detail views showing connection part (2.2) and the control, sensor and indicating means accommodated therein. In the example shown, connection part (2.2) is formed by connector member (2.4), which is connectable to tilt and turn joint (2.3), and connector member (2.5), which is connectable to the suction wand (not shown here). The two connector members (2.4 and 2.5) merge into each other at an angle, thus forming the connection part (2.2). Moreover, a locating element (18) for a parking aid is formed on the lower side of connection part (2.2).

A battery compartment (8) is provided in the lower portion of housing (7). A receiving chamber (7.1) for the electrical control device for dust-flow detection and for the dust-flow indicating means is formed in the upper portion of housing (7). At the end face facing upward toward connector member (2.5), the housing is further provided with a viewing window (9) for the dust-flow indicator. Thus, this viewing window faces toward the connection point for suction wand (3). Because of this, the indicator (9) is located in an easily visible region, because during vacuum cleaning, the user is always looking along suction wand (3) toward the indicating device. Battery compartment (8) is provided with a removable cover (8.1), as is customary for battery-operated devices. Thus, the batteries (13) are easily accessible for replacement.

The piezoelectric dust sensor (11) is mounted in the upper wall of connection part (2.2) in a receiving element (12.1) of a holding device (12). The piezoelectric dust sensor (11) protrudes at an angle into the dust-flow stream inside the tubular connection part (2.2).

Housing (7) accommodates batteries (13), a printed circuit board (14) for the electronic control device, as well as LED's (16) for the dust-flow indicator. A low-pressure switch (15) capable of activating the control device is mounted on printed circuit board (14) and is in communication with the dust-flow stream through its air inlet conduit (15.1) via an opening (17). Dust-flow indicating elements (16) are also attached to printed circuit board (14) and directed toward viewing window (9), so that the reading is displayable to the outside.

LED's (16) are disposed on printed circuit board (14) such that they are spaced from viewing window (9) by a distance matched according to the light radiation, so that, in combination with the selection of a suitable material for the viewing panel, a flat illumination is achieved for the viewing panel. Another characteristic feature is that the viewing panel is backlit in only one color (green, yellow, red) according to the detected level of dirt, firstly to provide a clear indication of the progress of the cleaning process, and secondly, to allow the indicator to be clearly read from all possible directions when combining the suction nozzle with different suction wands and handle members of the suction hose of the vacuum cleaner. Furthermore, this design approach contributes to stabilizing the display, largely preventing flickering of the LED's, which may be caused by the dust sensor signals, which by nature are highly fluctuating.

At the lower side of connection part (2.2), there is located a closable opening (19) through which the interior of the tubular member is accessible, for example, for cleaning or for replacing dust sensor (11).

As can be seen from FIG. 4, the impact surface and angular arrangement of dust sensor (11) are exposed to the upper portion of the air stream in the tubular portion of the connector member. This has the particular advantage that the heavy particles in the air stream are carried away beneath this sensor without reaching the impact surface thereof (see the direction of the arrows in the connection part). However, the light dust particles distributed over the entire cross-sectional area of the air stream are detected by dust sensor (11). Thus, this sensor system and this special arrangement of the sensor make it possible to achieve a level of cleanliness that allows even ultrafine dusts to be taken into account, which is beneficial to users who are allergic.

Advantageously, dust sensor (11) is disposed in the dust-air stream at an inclination angle (23) of 25 to 50 degrees relative to the upper wall of connection part (2.2).

Figure 5:
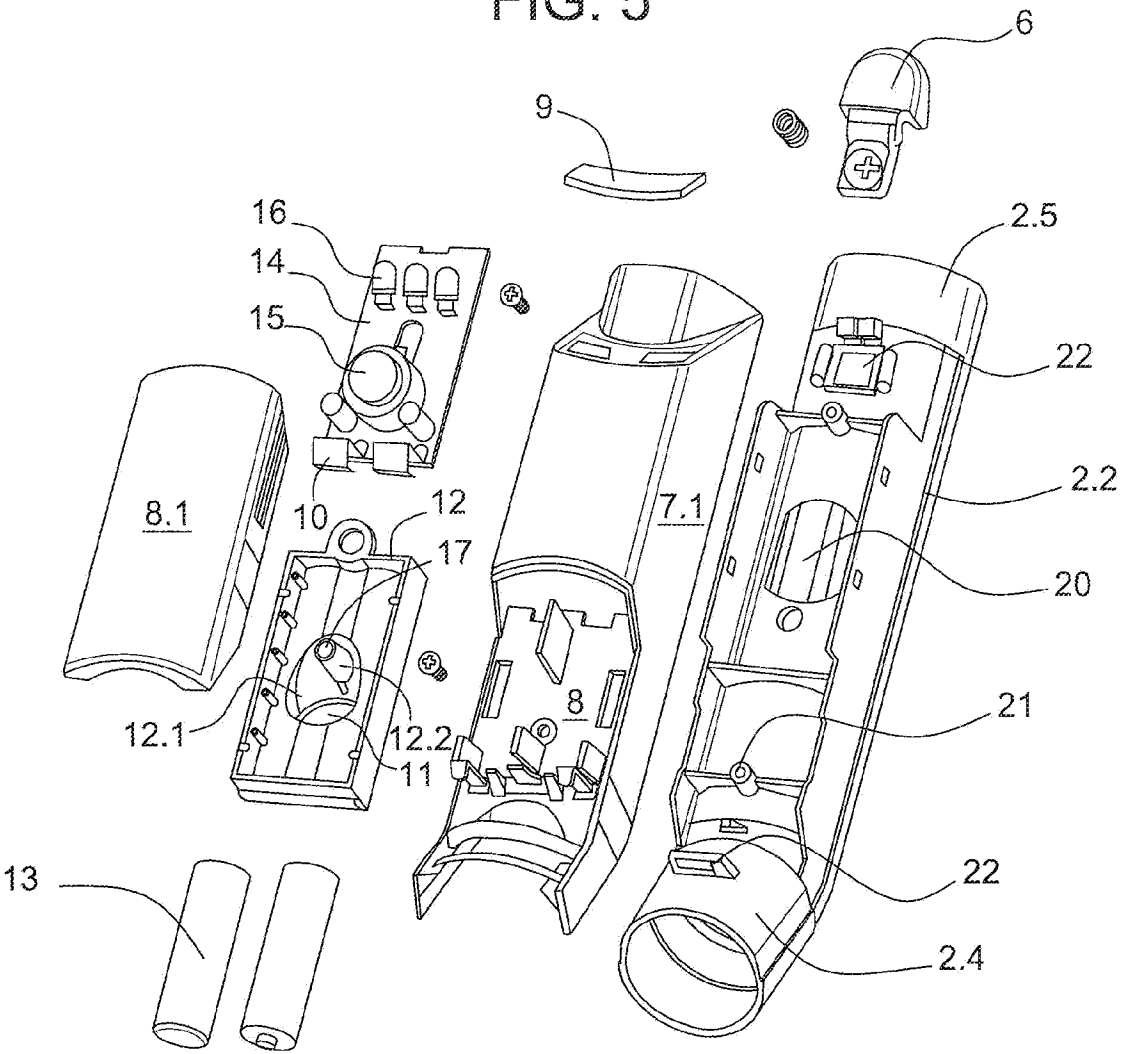
FIG. 5 shows the connection part of the suction nozzle in a perspective assembly view.

The configuration of connection part (2.2), including the housing (7) formed on its upper side and the components accommodated therein, can be seen in detail in the perspective assembly view of FIG. 5.

The upper housing part is a housing shell (7.2) which is adapted to the shape of connection part (2.2) on the upper side thereof. Connection part (2.2) is provided on its upper side with snap-in locking and fastening elements (21, 22) by which housing shell (7.2) can be snap-fitted and screwed to connection part (2.2).

Printed circuit board (14) is received by holding device (12) on the upper side thereof. Low-pressure switch (15) and indicating elements (16), as well as the control circuit (not shown here), are mounted on the printed circuit board. It may be advantageous to mount a reflector (not shown in this drawing) behind indicating elements (16), said reflector reflecting the light beams toward viewing window (9).

Connection to the batteries (13) is provided by current-conducting elements (10), the batteries (13) being insertable into battery compartment (8). The battery compartment can be closed by battery compartment cover (8.1).

Holding device (12) and printed circuit board (14) are arranged and configured such that air inlet conduit (15.1) of low-pressure switch (15) can be brought into communication with the interior of connection part (2.2) through opening (17) formed in receiving element (12.1) and through tubular member (12.2). When attaching holding device (12) on connection part (2.2), the receiving element (12.1) of the holding device penetrates through opening (20) formed on the upper side thereof and into the interior of connection part (2.2). Thus, dust sensor (11) is exposed to the dust-air stream, and air inlet conduit (15.1) of pressure switch (15) is located in the wind shadow of this receiving element (12.1) of the holding device. This has the particular advantage that the air inlet to the pressure switch is disposed such that it is protected from accumulations of dirt.

Indicating elements (16) take the form of green, yellow and red LED's. In the assembled state, the arrangement is such that indicating elements (16) are disposed relative to viewing window (9) at a position that is matched according to the light radiation. Together with the selection of a suitable material for viewing window (9), a flat, easily visible, flicker-free display is achieved. The user always sees a display which is red, yellow or green in color over its entire surface area, these colors representing the cleanliness levels "dirty", "slightly dirty", and "clean".

The connection part can also be designed as a separate part or accessory, in which case it can be connected between the suction nozzle (2) of a vacuum cleaner (1) and the suction wand (3) or suction hose (4) thereof. In that case, the connection part is similarly designed as connection part (2.2), except that, in addition, a connection element is provided also at its lower end, said connection element providing the connection to a connector member of nozzle part (2).

It is conceivable to use the present invention also in a different embodiment. Thus, for example, the sensor and indicator control may communicate with a central control unit in the vacuum cleaner via a wireless transmission system, which allows implementation of additional control and display options for the vacuum cleaning process. Furthermore, it is also conceivable that when using electric floor nozzles, the power supply to the sensor and indicator control may be derived in the connection part from the power supply system to the floor nozzle.

The invention claimed is:

1. A suction nozzle for a vacuum cleaner having at least one of a suction wand and a suction hose, the suction nozzle comprising:

a nozzle part having a suction mouth;

a tubular connection part configured to connect to at least one of the suction wand and the suction hose;

a holding device having a receiving element and being disposed at the upper side of the connection part;

a dust sensor disposed in a dust-air stream inside an upward portion of the connection part, the dust sensor being insertable underneath a housing of the connection part through an opening formed on an upper side of the connection part so as to protrude into the dust-air stream near an upper wall area of the connection part;

an indicating device having indicating elements indicating a dust flow, the indicating elements being disposed in a receiving chamber formed at the upper side of the connection part; and an electronic control device configured to analyze signals of the dust sensor and controlling the indicating device during operation;

wherein the dust sensor is a piezoelectric dust sensor disposed in the receiving element and protrudes at an angle into the dust-air stream and wherein the receiving element is insertable, together with the sensor, into an interior of the connection part through the opening.

2. The suction nozzle for a vacuum cleaner as recited in claim 1, wherein the angle is 25 to 50 degrees relative to the upper wall of the connection part.

3. The suction nozzle for a vacuum cleaner as recited in claim 1, further comprising a printed circuit board disposed at the upper side of the holding device and wherein the control device and the indicating elements are mounted on the printed circuit board.

4. The suction nozzle for a vacuum cleaner as recited in claim 3, further comprising a low-pressure switch disposed above the printed circuit board, a battery compartment disposed in the housing below the holding device, current conducting elements, and batteries disposed in the battery compartment and in communication with the control device via the current-conducting elements, wherein the control device is battery-operated and activatable by the low-pressure switch.

5. The suction nozzle for a vacuum cleaner as recited in claim 4, wherein the low-pressure switch includes an air inlet port in communication with dust-air stream inside the connection part via an aperture, the air inlet port being located in a wind shadow of at least one of the receiving element, the holding device and of the dust sensor.

6. The suction nozzle for a vacuum cleaner as recited in claim 1, wherein the housing includes an upwardly directed viewing window for the dust-flow indicator, the light signals of the indicating elements being displayable to an outside through the viewing window.

7. The suction nozzle for a vacuum cleaner as recited in claim 6, further comprising a printed circuit board and wherein the indicating elements include LEDs and are disposed on the printed circuit board and spaced from viewing window by a distance defined according to a light radiation of the LEDs, so that when the LEDs are activated a flat illumination is achieved for the viewing window.

8. The suction nozzle for a vacuum cleaner as recited in claim 7, further comprising a reflector mounted on the printed circuit board behind the indicating elements and reflecting light beams of the indicating elements toward the viewing window.

9. The suction nozzle for a vacuum cleaner as recited in claim 1, wherein the connection part includes snap-in locking and fastening elements on the upper side, and wherein the housing includes an upper housing shell, the upper housing shell and the holding device being attachable to the snap-in locking and fastening elements.

10. The suction nozzle for a vacuum cleaner as recited in claim 1, further comprising a parking aid mounted at a lower side of the connection part.

11. A suction nozzle for a vacuum cleaner, comprising:

a nozzle part having a suction mouth;

a tubular connection part configured to connect to at least one of the suction wand and the suction hose;

a dust sensor disposed in a dust-air stream inside an upward portion of the connection part, the dust sensor being insertable underneath a housing of the connection part through an opening formed on an upper side of the connection part so as to protrude into the dust-air stream near an upper wall area of the connection part;

an indicating device having indicating elements indicating a dust flow, the indicating elements being disposed in a receiving chamber formed at the upper side of the connection part; and an electronic control device configured to analyze signals of the dust sensor and controlling the indicating device during operation;

wherein the connection part includes a closable further opening in a lower wall opposite the dust sensor and allowing the dust sensor to be accessed from outside the connection part.

12. A connection part for a suction nozzle of a vacuum cleaner, the connection part comprising:

a first connecting portion disposed at a first side of the connection part and connectable to connector member of a suction nozzle;

a second connecting portion disposed at a second opposite side of the connection part and connectable to at least one of a suction wand and a suction hose of the vacuum cleaner;

a holding device having a receiving element and being disposed at the upper side of the connection part;

a dust sensor disposed in a dust-air stream inside an upward portion of the connection part, the dust sensor being insertable underneath a housing of the connection part through an opening formed on an upper side of the connection part so as to protrude into the dust-air stream near an upper wall area of the connection part; and an indicating device having indicating elements indicating a dust flow, the indicating elements being disposed in a receiving chamber formed at the upper side of the connection part;

wherein the dust sensor is a piezoelectric dust sensor disposed in the receiving element and protrudes at an angle into the dust-air stream and wherein the receiving element is insertable, together with the sensor, into an interior of the connection part through the opening.

* * * * *